US009064644B2

(12) United States Patent
Cuppett et al.

(10) Patent No.: US 9,064,644 B2
(45) Date of Patent: Jun. 23, 2015

(54) STRUCTURE FOR LIMITING BACK-TRAVEL OF INTERRUPTERS ON CIRCUIT BREAKERS

(71) Applicant: ABB Technology AG, Zurich (CH)

(72) Inventors: Matthew Cuppett, Uniontown, PA (US); Jonathan Fuge, Farmington, PA (US); Beth Dahm, Pittsburgh, PA (US); Mauricio Aristizabal, Pittsburgh, PA (US)

(73) Assignee: ABB Technology AG, Zurich (CH)

( * ) Notice: Subject to any disclaimer, the term of this patent is extended or adjusted under 35 U.S.C. 154(b) by 293 days.

(21) Appl. No.: 13/676,343

(22) Filed: Nov. 14, 2012

(65) Prior Publication Data

US 2014/0131178 A1 May 15, 2014

(51) Int. Cl.

| | |
|---|---|
| ***H01H 33/42*** | (2006.01) |
| ***H01H 3/32*** | (2006.01) |
| ***H01H 33/46*** | (2006.01) |
| ***H01H 9/20*** | (2006.01) |
| ***H01H 3/30*** | (2006.01) |

(52) U.S. Cl.

CPC ..... *H01H 9/20* (2013.01); *H01H 3/3021* (2013.01); *H01H 33/42* (2013.01)

(58) Field of Classification Search

CPC ..... H01H 3/30; H01H 9/20; H01H 33/42; H01H 33/46

USPC ..... 200/50.28–50.35, 50.01, 43.01, 43.11, 200/43.16, 48 R

See application file for complete search history.

(56) References Cited

U.S. PATENT DOCUMENTS

| | | | | |
|---|---|---|---|---|
| 3,562,463 | A * | 2/1971 | Charbonneau et al. | 200/425 |
| 3,780,625 | A * | 12/1973 | Weston et al. | 200/48 R |
| 3,825,228 | A | 7/1974 | Greutman | |
| 4,506,121 | A * | 3/1985 | Peterson et al. | 200/50.28 |
| 7,411,145 | B1 * | 8/2008 | Jones et al. | 200/400 |

FOREIGN PATENT DOCUMENTS

| | | |
|---|---|---|
| EP | 2161730 | 3/2010 |

OTHER PUBLICATIONS

International Search Report & Opinion in PCT/US2013165339 dated Apr. 15, 2014.

* cited by examiner

*Primary Examiner* — Amy Cohen Johnson
*Assistant Examiner* — Marina Fishman
(74) *Attorney, Agent, or Firm* — Manelli Selter PLLC; Edward J. Stemberger

(57) ABSTRACT

Holding structure includes a gear rack member for coupling with an object for movement therewith. The gear rack member includes a set of a teeth and a cam profile surface. A latch is associated with the set of teeth so as to engage and disengage the teeth. A cam follower is fixed to the latch to engage the cam profile surface thereby defining the engaged or disengaged position of the latch with respect to the teeth. A spring provides torque on the latch. The holding structure is constructed and arranged such that during movement of the object in an intended direction, the latch engages the teeth and is held in the engaged position by the spring so as to stop any movement of the object in a direction that is opposite the intended direction, otherwise, the spring is constructed and arranged to hold the latch in the disengaged position.

16 Claims, 4 Drawing Sheets

STRUCTURE FOR LIMITING BACK-TRAVEL OF INTERRUPTERS ON CIRCUIT BREAKERS

FIELD

The invention relates to circuit breakers and, more particularly, to structure for limiting back-travel of the interrupters.

BACKGROUND

Dead tank circuit breakers are commonly found in substations and are operable to selectively open and close electrical connections. These circuit breakers include movable interrupters. Back travel or movement of the interrupters in the wrong direction can be caused by high-pressure build-up during high short-circuit interruption. Back-travel of an interrupter can cause restrikes, a dielectric failure of an interrupter. Restrikes are problematic for the breaker and surrounding equipment if current starts flowing again.

Thus, there is a need to provide structure to stop backward motion of and object, such as an interrupter during the opening thereof, so that the object is unable to move in the wrong direction.

SUMMARY

An objective of the invention is to fulfill the need referred to above. In accordance with the principles of the present invention, this objective is obtained by providing holding structure for stopping an object from moving in a direction that is opposite an intended direction of movement of the object. The structure comprises a gear rack member constructed and arranged to be coupled with the object for movement therewith. The gear rack member includes at least a first set of teeth and at least one cam profile surface. Latch structure includes at least one latch associated with the first set of teeth so as to engage and disengage the teeth. A cam follower is fixed to the latch structure and is constructed and arranged to engage the cam profile surface thereby defining the engaged or disengaged position of the latch with respect to the teeth. A spring provides torque on the latch. The holding structure is constructed and arranged such that during movement of the object in the intended direction, the latch engages the teeth and is held in the engaged position by the spring so as to stop any movement of the object in the direction that is opposite the intended direction, otherwise, the spring is constructed and arranged to hold the latch in the disengaged position.

In accordance with another aspect of an embodiment, holding structure is provided for stopping back-travel of an interrupter of a circuit breaker during an opening operation of the interrupter. The structure includes a gear rack member constructed and arranged to be coupled with a drive transmission associated with the interrupter for movement with the drive transmission. The gear rack member includes at least a first set of teeth and at least one cam profile surface. Latch structure includes at least one latch associated with the first set of teeth so as to engage and disengage the teeth. A cam follower is fixed to the latch and is constructed and arranged to engage the cam profile surface thereby defining the engaged or disengaged position of the latch with respect to the teeth. A spring provides torque on the latch. The holding structure is constructed and arranged such that during an opening movement of the interrupter, the latch engages the teeth and is held in the engaged position by the spring so as to stop any movement of the drive transmission and thus the interrupter in the direction that is opposite the intended direction, otherwise, the spring is constructed and arranged to hold the latch in the disengaged position.

In accordance with another aspect of an embodiment, a method of controlling movement of an interrupter of a circuit breaker is provided. A drive transmission is coupled with the interrupter. The method provides holding structure coupled with the drive transmission. During an opening movement of the interrupter in an intended direction, movement of the drive transmission in a direction opposite the intended direction is stopped by the holding structure.

Other objectives, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXEMPLARY EMBODIMENTS

Figure 1:
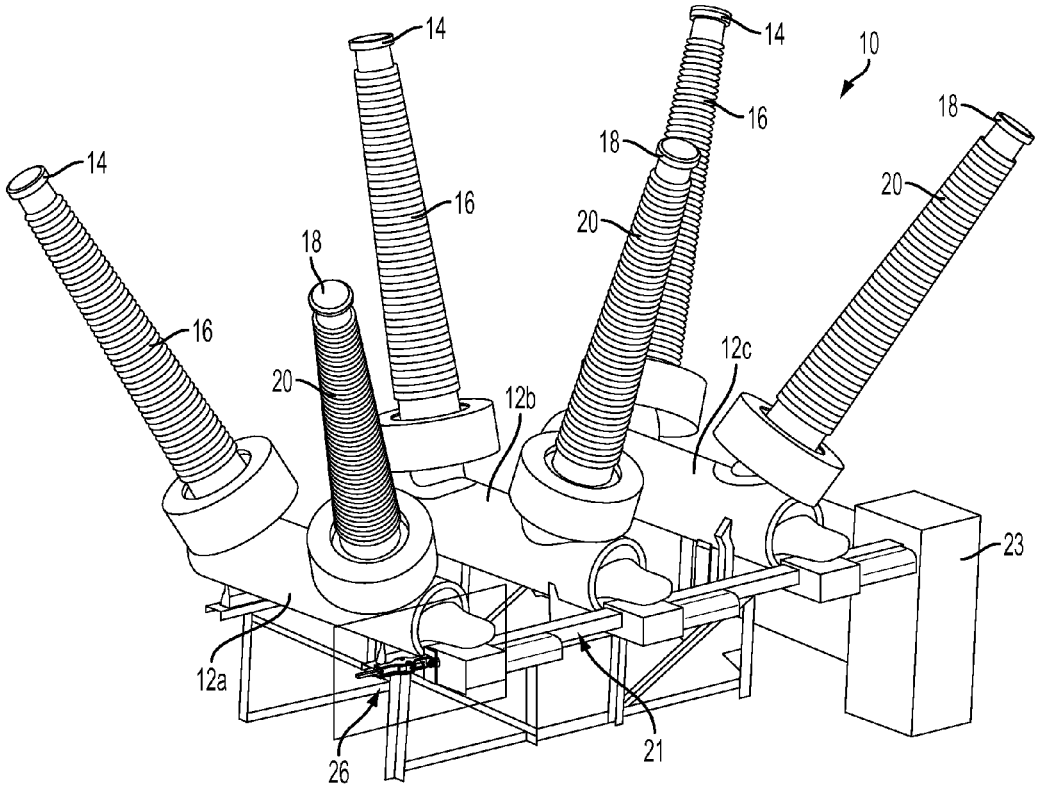
FIG. 1 is a view of a high voltage circuit breaker provided in accordance with an embodiment.

With reference to FIG. 1, a dead-tank circuit breaker is shown, generally indicated at 10. Circuit breaker 10 is preferably a three phase circuit breaker and thus includes three pole assemblies 12*a*, 12*b* and 12*c*. Each pole assembly 12 includes a first electrical conductor 14 carried in a first bushing 16 and a second electrical conductor 18 carried in a second bushing 20. Electrical power lines are coupled to the first and second electrical conductors 14 and 18, and the circuit breaker 10 selectively opens or closes the electrical connection there-between. It can be appreciated that the number of pole assemblies 12 can be selected for the desired application and need not be limited to three.

Figure 2:
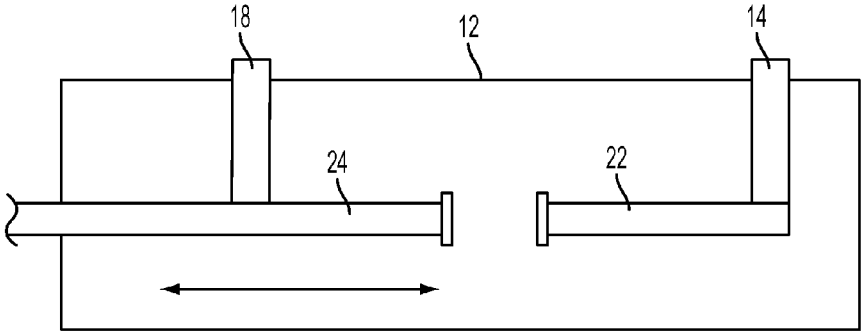
FIG. 2 is a schematic view of an interior of a breaker pole of the circuit breaker of FIG. 1, wherein the electrical contacts are open.

With reference to FIG. 2, a simplified view of an interior of a pole assembly 12 is shown, wherein first electrical conductor 14 is electrically connected to a stationary contact 22 which is immovably secured within pole assembly 12. Second electrical conductor 18 is electrically connected to a movable contact 24 which is carried within pole assembly 12 in a manner allowing longitudinal movement therein. Thus, in a first position, the movable contact 24 may be positioned to break the electrical connection between first the electrical conductor 14 and second electrical conductor 18 (FIG. 2). In a second position, the movable contact 24 may be brought into contact with stationary contact 22 to electrically connect the first electrical conductor 14 and the second electrical conductor 18.

Typically, a bell crank assembly (not shown) is coupled with the movable electrical contact 24 of a respective pole assembly 12*a*, 12*b* and 12*c* for opening and closing the electrical connection between conductors 14 and 18. The bell crank assemblies are conventional and can be of the type disclosed in U.S. Patent Application Publication No. 20100270136A1, the content of which is hereby incorporated by reference into this specification. The bell crank assemblies are preferably interconnected by a gang-style linkage structure, generally indicated at 21, so that the pole assemblies are actuated at the same time by a single, electrically controlled operating mechanism 23.

Figure 3:
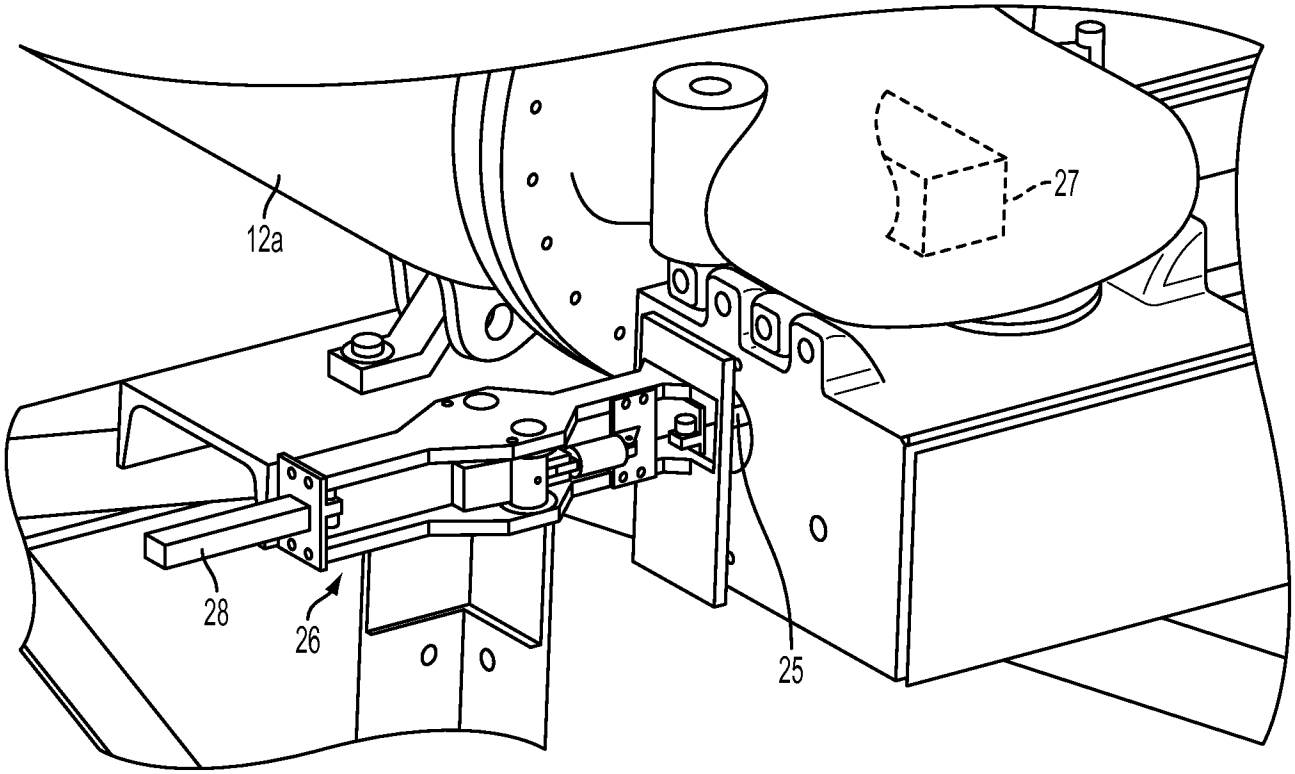
FIG. 3 is an enlarged view of the portion enclosed in FIG. 1, showing the gear rack structure of an embodiment.

FIG. 3 is an enlarged view of the portion enclosed in FIG. 1. Thus, FIG. 3 shows a portion of drive transmission 25 associated with an interrupter 27 provided in each pole assembly 12. FIG. 3 also shows holding structure in the form of a gear rack structure, generally indicated at 26, provided in accordance with an embodiment and coupled with the drive transmission 25 to stop backward motion of an interrupter during the opening operation thereof.

Figure 4:
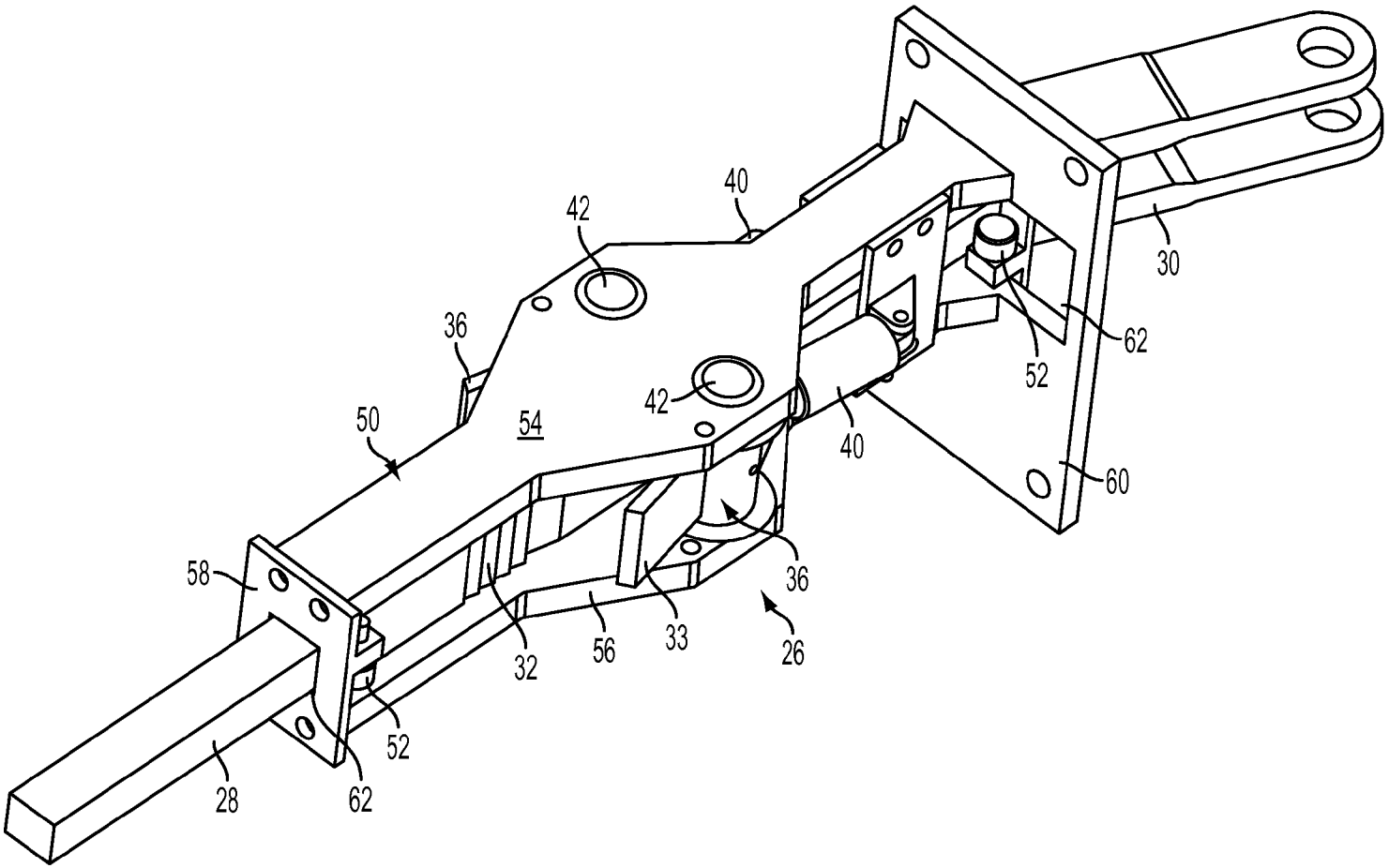
FIG. 4 is a perspective view of the gear rack structure of FIG. 3, in accordance with an embodiment.

As shown in FIG. 4, the gear rack structure 26 includes a gear rack member 28 coupled to a linkage 30 for movement therewith. The linkage 30 is constructed arranged to be coupled to the conventional breaker drive transmission 25 (FIG. 3) that is external to the interrupter 27, but coupled with the interrupter 27. The gear rack structure 26 is preferably symmetrical about axis A. Thus, only one side of the structure 26 will be described herein, with the understanding that the opposite side functions similarly.

Figure 5:
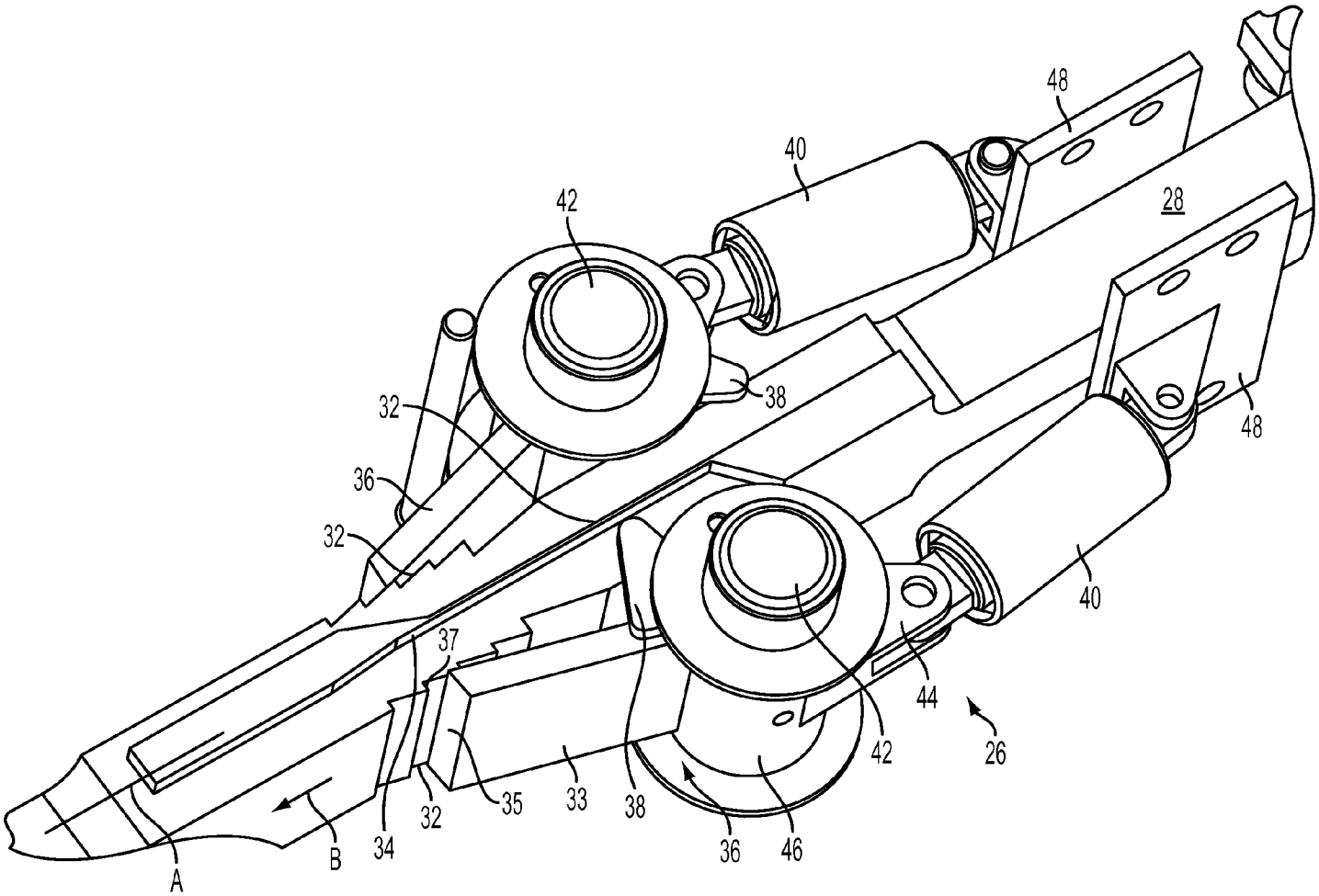
FIG. 5 is a view of a portion of the gear rack structure shown with housing structure removed.

As shown in FIGS. 4 and 5, the gear rack member 28 includes teeth 32 and a cam profile surface 34. The cam profile surface 34 sets the engaged or disengaged position of a latch 33 of a latch structure, generally indicated at 36. The latch structure 36 includes a static cam follower 38 that rides along the associated cam profile surface 34. During the opening movement of the drive interrupter and thus drive transmission 25, the planar surface 35 of the latch 33 engages a planar surface 37 of an associated tooth 32 to stop the breaker transmission 25 from back-traveling or moving in the direction B, which is opposite the intended direction of movement of the drive transmission 25, thereby stopping back-traveling of the associated interrupter. Otherwise, as the gear rack member 28 moves linearly, the latch 33 ratchets over the teeth 32 in a disengaged position.

During the close movement of the interrupter and thus drive transmission 25, as shown in FIG. 4, the latch 33 is stored in a safe position, disengaged with the teeth 32. The engaged and disengaged positions of the latch 33 are held by a coil spring 40 that provides a torque on the latch structure 36 that is disposed about a pin 42 in such a manner that being held at an intermediate center position is not possible as it is physically unstable at that point. The spring 40 thus holds the latch 33 in its engaged or disengaged position until conditions of the breaker transmission change, e.g., the breaker transmission moves from closed-to-open or open-to-close. One end of the spring 40 is coupled to an arm 44 that is coupled to a boss 46 of the latch structure 36. The boss 46 surrounds the pin 42 so as to rotate about the pin 42. The latch 33 is coupled to the boss 46 so as to rotate therewith. The other end of the spring 40 is coupled to a spring plate 48 that is fixed to housing structure, generally indicated at 50, by fasteners or the like. The gear rack member 28 is guided for linear movement at each end thereof by rollers 52.

The housing structure 50 holds the components described above in place. In the embodiment, the housing structure 50 includes a top plate 54 and a bottom plate 56 that are joined together by two side plates 58 and 60. Plate 60 can also be used to mount the gear rack structure 26. Each of the side plates 58, 60 has an opening 62 permitting a portion of the gear rack member 28 to pass there-through.

As noted above, since the gear rack structure 26 is symmetrical, it includes a second set of components, e.g., the teeth 32, cam follower 34, latch 36, cam 38, spring 40 and pin 42 so as to provide the sufficient strength for certain applications. However, it can be appreciated that only one set of such components can be provided for other, less demanding applications.

Although the gear rack structure 26 has been described for use in a dead tank circuit breaker, the structure 26 can be employed in any type of circuit breaker and can be coupled with the drive transmission and thus the interrupter in many different manners. The structure 26 can be used in a retrofit manner on existing circuit breakers so that lower current dead bolt circuit breakers can be increased to higher current ratings.

Furthermore, it can be appreciated that the gear rack structure 26 is not limited to use in circuit breakers, but can be used to stop any object coupled therewith from moving in the wrong direction.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A holding structure for stopping an object from moving in a direction that is opposite an intended direction of movement of the object, the holding structure comprising:

a gear rack member constructed and arranged to be coupled with the object for movement therewith, the gear rack member including at least a first set of teeth and at least one cam profile surface, a latch structure including at least one latch associated with the first set of teeth so as to engage and disengage the teeth, a cam follower fixed to the latch structure and constructed and arranged to engage the cam profile surface thereby defining the engaged or disengaged position of the latch with respect to the teeth, and a spring providing torque on the latch, wherein, the holding structure is constructed and arranged such that during movement of the object in the intended direction, the latch engages the teeth and is held in the engaged position by the spring so as to stop any movement of the object in the direction that is opposite the intended direction, otherwise, the spring is constructed and arranged to hold the latch in the disengaged position.

2. The holding structure of claim 1, wherein the gear rack member includes a second set of a teeth and a second cam profile surface, the holding structure further comprises:

a second latch structure including a second latch associated with the second set of teeth so as to engage and disengage teeth of the second set, a second cam follower fixed to the second latch and constructed and arranged to engage the second cam profile surface thereby defining the engaged or disengaged position of the second latch with respect to the teeth of the second set, and a second spring providing torque on the second latch.

3. The holding structure of claim 1, further comprising a pin, the latch structure being mounted for rotation about the pin.

4. The holding structure of claim 3, wherein the latch structure further comprises a boss mounted for rotation about the pin and an arm extending from the boss, the latch being coupled to the boss for rotation therewith, one end of the spring being coupled to the arm, with another end of the spring being coupled to a stationary spring plate.

5. The holding structure of claim 2, further comprising a first pin, the latch structure being mounted for rotation about the first pin, and further comprising a second pin, the second latch structure being mounted for rotation about the second pin.

6. The holding structure of claim 5, wherein the second latch structure further comprises a boss mounted for rotation about the second pin and an arm extending from the boss, the second latch being coupled to the boss for rotation therewith, one end of the second spring being coupled to the arm, with another end of the second spring being coupled to a stationary spring plate.

7. The holding structure of claim 1, wherein the latch has a planar surface and each of the teeth has a planar surface so that when in the engaged position, the planar surface of the latch engages the planar surface of a tooth.

8. The holding structure of claim 1, wherein the object is a drive transmission of a circuit breaker.

9. A holding structure for stopping back-travel of an interrupter of a circuit breaker during an opening operation of the interrupter, the holding structure comprising:

a gear rack member constructed and arranged to be coupled with a drive transmission associated with the interrupter for movement with the drive transmission, the gear rack member including at least a first set of teeth and at least one cam profile surface, a latch structure including at least one latch associated with the first set of teeth so as to engage and disengage the teeth, a cam follower fixed to the latch and constructed and arranged to engage the cam profile surface thereby defining the engaged or disengaged position of the latch with respect to the teeth, and a spring providing torque on the latch, wherein, the holding structure is constructed and arranged such that during an opening movement of the interrupter, the latch engages the teeth and is held in the engaged position by the spring so as to stop any movement of the drive transmission and thus the interrupter in the direction that is opposite the intended direction, otherwise, the spring is constructed and arranged to hold the latch in the disengaged position.

10. The holding structure of claim 9, wherein the gear rack member includes a second set of teeth and a second cam profile surface, the holding structure further comprises:

a second latch structure including a second latch associated with the second set of teeth so as to engage and disengage teeth of the second set, a second cam follower fixed to the second latch and constructed and arranged to engage the second cam profile surface thereby defining the engaged or disengaged position of the second latch with respect to the teeth of the second set, and a second spring providing torque on the second latch.

11. The holding structure of claim 9, further comprising a pin, the latch structure being mounted for rotation about the pin.

12. The holding structure of claim 11, wherein the latch structure further comprises a boss mounted for rotation about the pin and an arm extending from the boss, the latch being coupled to the boss for rotation therewith, one end of the spring being coupled to the arm, with another end of the spring being coupled to a stationary spring plate.

13. The holding structure of claim 10, further comprising a first pin, the latch structure being mounted for rotation about the first pin, and further comprising a second pin, the second latch structure being mounted for rotation about the second pin.

14. The holding structure of claim 13, wherein the second latch structure further comprises a boss mounted for rotation about the second pin and an arm extending from the boss, the second latch being coupled to the boss for rotation therewith, one end of the second spring being coupled to the arm, with another end of the second spring being coupled to a stationary spring plate.

15. The holding structure of claim 9, wherein the latch has a planar surface and each of the teeth has a planar surface so that when in the engaged position, the planar surface of the latch engages the planar surface of a tooth.

16. A method of controlling movement of an interrupter of a circuit breaker, a drive transmission being coupled with the interrupter, the method comprising:

providing a holding structure coupled with the drive transmission, and during an opening movement of the interrupter in an intended direction, stopping movement of the drive transmission in a direction opposite the intended direction, by the holding structure, wherein the holding structure comprises:

a gear rack member coupled to the drive transmission, the gear rack member including at least a first set of teeth and at least one cam profile surface, a latch structure including at least one latch associated with the first set of teeth so as to engage and disengage the teeth, a cam follower fixed to the latch structure and constructed and arranged to engage the cam profile surface thereby defining the engaged or disengaged position of the latch with respect to the teeth, and a spring providing torque on the latch, wherein the stopping step includes engaging the latch with the teeth.

* * * * *